United States Patent [19]

Radwanski

[11] Patent Number: 4,970,104

[45] Date of Patent: Nov. 13, 1990

[54] NONWOVEN MATERIAL SUBJECTED TO HYDRAULIC JET TREATMENT IN SPOTS

[75] Inventor: Fred R. Radwanski, Norcross, Ga.

[73] Assignee: Kimberly-Clark Corporation, Neenah, Wis.

[21] Appl. No.: 170,193

[22] Filed: Mar. 18, 1988

[51] Int. Cl.[5] ..... B32B 7/04

[52] U.S. Cl. ..... 428/198; 428/145; 428/245; 428/283; 428/253; 428/284; 428/292; 428/299; 428/903

[58] Field of Search ..... 428/195, 196, 197, 198, 428/253, 284, 283, 298, 299, 903, 245

[56] References Cited

U.S. PATENT DOCUMENTS

| | | | |
|---|---|---|---|
| Re. 31,601 | 6/1984 | Ikeda et al. | 428/93 |
| 2,862,251 | 12/1958 | Kalwaites | 19/161 |
| 3,033,721 | 5/1962 | Kalwaites | 154/46 |
| 3,068,547 | 12/1962 | L'Hommedieu | 28/78 |
| 3,081,514 | 3/1963 | Griswold | 28/78 |
| 3,129,466 | 4/1964 | L'Hommedieu | 19/145 |
| 3,193,436 | 7/1965 | Kalwaites | 428/299 |
| 3,485,706 | 12/1969 | evans | 161/72 |
| 3,485,709 | 12/1969 | Evans et al. | 428/224 |
| 3,486,168 | 12/1969 | Evans et al. | 161/169 |
| 3,494,821 | 2/1970 | Evans | 161/169 |
| 3,498,874 | 3/1970 | Evans | 161/109 |
| 3,560,326 | 2/1971 | Bunting et al. | 161/169 |
| 3,769,659 | 11/1973 | Kalwaites | 19/161 P |
| 3,800,364 | 4/1974 | Kalwaites | 19/161 P |
| 3,837,046 | 9/1974 | Kalwaites | 19/161 P |
| 4,016,317 | 4/1977 | Kalwaites | 428/88 |
| 4,144,370 | 3/1979 | Boulton | 428/233 |
| 4,152,480 | 5/1979 | Adachi et al. | 428/227 |

(List continued on next page.)

FOREIGN PATENT DOCUMENTS

| | | |
|---|---|---|
| 841938 | 5/1970 | Canada . |
| 092819 | 11/1983 | European Pat. Off. . |
| 223614 | 5/1987 | European Pat. Off. . |
| 239080 | 9/1987 | European Pat. Off. . |
| 1371863 | 10/1974 | United Kingdom . |
| 1596718 | 8/1981 | United Kingdom . |
| 2114173 | 8/1983 | United Kingdom . |

OTHER PUBLICATIONS

"The Outlook for Durable and Disposable Nonwoven Markets Through the 1980's" T. M. Holliday & Assocs. and R. G. Mansfield & Assoc. pp. 167–200.

"Spunlaced Products: Technology and End-Use Applications" E. I. du Pont de Nemours & Company Inc. Section XII.

*Primary Examiner*—James J. Bell

*Attorney, Agent, or Firm*—Joseph P. Harps; Karl V. Sidor

[57] ABSTRACT

Nonwoven materials, methods of forming the same, and apparatus for forming the same, are disclosed. The nonwoven materials include at least one nonwoven web, with the at least one web being bonded by entangle bonding in spots, such entangle bonding being provided by hydraulic entangling. As a specific embodiment, elastomeric laminates are formed, the at least one nonwoven web subjected to spot-entangle-bonding including an elastomeric web spot-entangle-bonded to another web so as to form an elastomeric laminate. By spot-entangle-bonding (jet treating) the webs, utilizing hydraulic entangling to provide the spot-entangle-bonds, conventional bonding methods need not be used, whereby good hand and drape properties can be retained after bonding, and the overall bulk of the material can be maintained, while providing a product that does not easily delaminate and that is stretchable and resilient. Also disclosed is an apparatus for carrying out the spot-entangle-bonding, including two rotatable perforated drums having water jet manifolds inside thereof, the nonwoven material passing on the circumference thereof, with high pressure water jets issuing from the manifolds and through openings in the perforated drum so as to achieve hydraulic entangling of the nonwoven material at spots corresponding to openings of the perforated drums, with one side of the nonwoven material being adjacent the surface of one of the rotatable perforated drums and the opposite side of the nonwoven material being adjacent the surface of the other rotatable perforated drum.

27 Claims, 2 Drawing Sheets

U.S. PATENT DOCUMENTS

| | | | |
|---|---|---|---|
| 4,209,563 | 6/1980 | Sisson | 428/288 |
| 4,296,163 | 10/1981 | Emi | 428/212 |
| 4,297,404 | 10/1981 | Nguyen | 428/224 |
| 4,446,189 | 5/1984 | Romanek | 428/152 |
| 4,514,455 | 4/1985 | Hwang | 428/198 |
| 4,555,430 | 11/1985 | Mays | 428/299 |
| 4,657,802 | 4/1987 | Morman | 428/152 |
| 4,720,415 | 1/1988 | Vanee Wielen et al. | 428/152 |
| 4,753,839 | 6/1988 | Greenway | 428/224 |
| 4,755,421 | 7/1988 | Manning et al. | 428/224 |
| 4,775,579 | 10/1988 | Hagy et al. | 428/903 |
| 4,797,318 | 1/1989 | Brooker et al. | 428/903 |
| 4,808,467 | 2/1989 | Suskind et al. | 428/284 |
| 4,818,594 | 4/1989 | Albien et al. | 42/154 |
| 4,840,829 | 6/1989 | Suzuki et al. | 428/224 |

NONWOVEN MATERIAL SUBJECTED TO HYDRAULIC JET TREATMENT IN SPOTS

BACKGROUND OF THE INVENTION

The present invention relates to a bonded nonwoven material, and method and apparatus for forming the same. In particular, the present invention relates to a nonwoven web (either elastic or nonelastic), and a nonwoven laminate (e.g., a nonwoven fibrous elastic laminate comprising at least one nonwoven elastic web together with at least one further nonwoven web), with the material (either a single web or laminate) being bonded to form the bonded nonwoven material.

It has been desired to provide bonded nonwoven materials (e.g., nonwoven webs, either elastic or nonelastic, of a single web or of a laminate) having high overall bulk, hand and drape. It has been particularly desired to provide such nonwoven material having high overall bulk, from an initial material with high bulk but not sufficiently self-supporting, wherein the final product (which is sufficiently self-supporting) has been bonded while avoiding any substantial decrease in overall bulk, the final product retaining good hand and draping properties after bonding.

It has also been desired to provide nonwoven elastic laminates that are both stretchable and resilient, and which retain good hand and draping properties after bonding.

U.S. Pat. No. 4,016,317 to Kalwaites discloses nonwoven fabrics having patterns of areas of low fiber density or holes and patterns of fiber bundles of parallelized consolidated fiber segments, the predetermined pattern of areas being partially or entirely defined by yarn-like fiber bundles, the junctures in the fabric (that is, the areas where the fiber bundles intersect one another) possibly comprising areas of highly entangled fiber segments. The described fabric has one surface which is smooth and substantially free of fiber ends, while the opposite surface contains a plurality of fiber ends held together by a binder to form tufts of bonded fiber ends on the surface. This patent discloses that the fabric is formed by placing a fibrous web comprising staple length fibers on a foraminous support wire, the foraminous support having from about 200 to about 8100 openings per square inch to provide from about 20 to 70% open area in the support so that the staple length fibers will span at least two of the openings, with fiber rearranging forces being directed against the fibrous web to move fiber segments into closer proximity to one another and increased parallelism to form fiber bundles defining areas of low fiber density therebetween, individual fiber ends being forced down through the openings in the foraminous support member. This patent discloses specific apparatus including a rotatable apertured drum. Inside the drum is a stationary manifold to which a fluid is applied; on one side of the manifold is a series of nozzles for directing the fluid toward the drum periphery. A backing belt extends about a large portion of the periphery of the drum, and, together with the apertured drum, provides a rearranging zone between them through which a fibrous material moves to be rearranged, under the influence of applied fluid forces, into a nonwoven fabric having the previously discussed pattern.

Kalwaites describes use of staple length fibers which span at least two of the openings in the support wire; the present invention is not so limited, and, as discussed further herein, is applicable to fibers having lengths less than staple fibers (that is, is applicable to pulp fibers, even those having lengths less than 0.25 inch). In Kalwaites, fiber rearrangement occurs so as to provide areas of low fiber density; such areas of low fiber density are weak points in the final structure. In the present invention, on the other hand, the holes and low density areas are limited; and when meltblown fibers are used in the present invention, areas of low fiber density are avoided.

U.S. Pat. No. 3,485,706 to Evans discloses a textile-like nonwoven fabric and a process and apparatus for its production, wherein the fabric has fibers randomly entangled with each other in a repeating pattern of localized entangled regions interconnected by fibers extending between adjacent entangled regions. The process disclosed in this patent involves supporting a layer of fibrous material on an apertured patterning member for treatment, jetting liquid supplied at pressures of at least 200 pounds per square inch (psi) gauge to form streams having over 23,000 energy flux in foot-pounds/inch$^2$.second at the treatment distance, and traversing the supporting layer of fibrous material with the streams to entangle fibers in a pattern determined by the supporting member, using a sufficient amount of treatment to produce uniformly patterned fabric. The initial material is disclosed to consist of any web, mat, batt or the like of loose fibers disposed in random relationship with one another or in any degree of alignment.

U.S. Pat. No. 4,209,563 to Sisson discloses a method of forming an elastic cloth structure, and the cloth structure formed, including simultaneously melt spinning a stream of filaments of fiber-forming synthetic organic polymer from an extruder through a die or a spinnerette, the filaments then being mechanically reduced to textile denier by being drawn, e.g., by a draw roll, the drawn filaments then being forwarded by forwarding means to random or directed formation onto a moving porous forming surface, with the filaments being bonded following laydown or collection. In accordance with one aspect disclosed in this patent, a cloth structure is formed comprised of at least two types of preferably continuous filaments, at least one of which is relatively elastomeric and at least one of which is elongatable but relatively nonelastic; at least one of these types of filaments is dispersed to provide frequent random fiber crossings at least some of which are bonded, either directly or indirectly and preferably autogenously, to form a coherent cloth. Subsequent to forming the coherent (bonded) cloth, the bonded cloth, e.g., is stretched, preferably substantially and uniformly in at least one direction, followed by substantially complete cloth relaxation to develop a low modulus of elasticity therein in at least such one direction. This patent goes on to describe that the relatively elastomeric filaments and elongatable but relatively nonelastic filaments can be laid as superposed layers or as a mixed layer to provide numerous well dispersed fiber crossings weld bonded by the application of heat and pressure to at least some of the fiber crossings to provide a coherent bonded nonwoven cloth.

U.S. Pat. No. 4,296,163 to Emi et al discloses a fibrous composite having elasticity, comprised of a coalesced assembly of (A) a sheet-like mesh structure composed of fibers of a synthetic elastomeric polymer, the individual fibers of which are interconnected at random in irregular relationship to form a number of meshes of different sizes and shapes, with the mesh structure having a recovery ratio after 10% stretch of at least 70% in two arbitrarily selected, mutually perpendicular directions on the plane of the mesh structure, and (B) a mat-, web- or sheet-like fiber structure composed of short or long fibers, with the fiber structure having a recovery ratio after 10% stretch of less than 50% in at least one arbitrarily selected direction. It is stated that the formed elastic composite is suitable for various apparel-based materials and industrial materials such as filter cloths, absorbents, and heat insulating materials.

U.S. Pat. No. 4,514,455 to Hwang discloses a composite nonwoven fabric which comprises a batt of crimped polyester staple fibers and a bonded sheet of substantially continuous polyester filaments. The batt and sheet are in surface contact with each other and are attached to each other by a series of parallel seams having a spacing of at least 1.7 cm between successive seams. In one embodiment, the seams are jet tracks which are a result of hydraulic stitching. In the fabric produced in Hwang, the bonds are interconnected in the continuous jet tracks, while in the present invention the spots of bonding area are not connected with each other.

U.S. Reissue Pat. No. 31,601 to Ikeda et al discloses a fabric, useful as a substratum for artificial leather, which comprises a woven or knitted fabric constituent and a nonwoven fabric constituent. The nonwoven fabric constituent consists of numerous extremely fine individual fibers which have an average diameter of 0.1 to 6.0 microns and which are randomly distributed and entangled with each other to form a body of nonwoven fabric. The nonwoven fabric constituent and the woven or knitted fabric constituent are superimposed and bonded together, to form a body of composite fabric, in such a manner that a portion of the extremely fine individual fibers and the nonwoven fabric constituent penetrate into the inside of the woven or knitted fabric constituent and are entangled with a portion of the fibers therein. The composite fabric is disclosed as being produced by superimposing the two fabric constituents on each other and jetting numerous fluid streams ejected under a pressure of from 15 to 100 kg/cm$^2$ toward the surface of the fibrous web constituent. This patent discloses that the extremely fine fibers can be produced by using any of the conventional fiber-producing methods, preferably a meltblowing method.

U.S. Pat. No. 4,446,189 to Romanek discloses a nonwoven textile fabric laminate which includes at least one layer of nonwoven textile fabric which is elongatable, and which is secured by needle punching to an elastic layer so that the nonwoven layer of textile fabric will be permanently stretched when the elastic layer is drafted within its elastic limits. After such drafting, when the elastic layer is allowed to relax and return to substantially its condition prior to being drafted, the nonwoven fabric layer is stated to exhibit increased bulk as a result of its concurrent relaxation. It is also stated that the nonwoven textile fabric laminate may be utilized to form wearing apparel which has enhanced freedom of movement.

U.S. Pat. No. 4,657,802 to Morman discloses a process for producing a composite nonwoven elastic web which is composed of a nonwoven elastic web that is joined to a fibrous nonwoven gathered web, and the composite web formed. The composite elastic web, according to U.S. Pat. No. 4,657,802, is formed by joining the fibrous nonwoven gatherable web to the nonwoven elastic web (e.g., forming the gatherable web on the elastic web) while the nonwoven elastic web is maintained at an elongated (stretched), biased length; because the fibrous nonwoven gatherable web is formed onto the surface of the nonwoven elastic web while the elastic web is being maintained at its stretched, biased length, the fibrous nonwoven gatherable web is in an ungathered but gatherable condition. In one embodiment described in this patent, joining of the gatherable and elastic webs is achieved by heat-bonding to fuse the two webs to each other; in another embodiment, joining of the fibrous nonwoven gatherable web to the stretched nonwoven elastic web is achieved solely by the entanglement of the fibers of the fibrous nonwoven gatherable web with the nonwoven elastic web during formation of the fibrous gatherable web on the surface of the elastic web. In connection with this latter embodiment, the patent discloses that if the nonwoven elastic web is a fibrous nonwoven elastic web formed by, e.g., meltblowing, entanglement of the fibers of the fibrous nonwoven gatherable web with the fibrous nonwoven elastic web is achieved by entanglement of the fibers of the fibrous gatherable web with the fibers of the fibrous elastic web. In a still further embodiment described in this patent, the nonwoven elastic web is made out of a tacky elastic material, whereby the fibrous nonwoven gatherable material is adhesively joined to the surface of the tacky elastic web. This patent goes on to disclose that, in any of these embodiments, after joining of the two webs to each other to form a composite elastic web, the biasing force is removed from the composite nonwoven elastic web and the composite elastic web is allowed to relax to its normal relaxed, unbiased length, resulting in the gatherable web being carried with the contracting nonwoven elastic web and thus being gathered.

Notwithstanding the teachings of the above-discussed references, it is desired to provide bonded nonwoven material having high overall bulk, and, in particular, wherein the overall bulk of the material subjected to bonding (to form the bonded nonwoven material) is not substantially decreased by the bonding, while providing a bonded nonwoven material having good hand and drape. It is desired to provide a bonded nonwoven material, of either a single web or a laminate, of an elastic and/or a nonelastic material, having high overall bulk and good hand and drape. It is desired to provide such bonded nonwoven material without use of conventional bonding techniques such as fusion or chemical bonding, mechanical needling, etc.

Moreover, notwithstanding the teachings of the above-discussed references, there is still a desire to provide bonded elastic nonwoven materials that retain high overall bulk after bonding and have good stretch and recovery properties, without decreased hand and draping due to the bonding. Moreover, it is still desired to provide a nonwoven elastic laminate material (e.g., a nonwoven elastic laminate web) that is cloth-like, stretchable and resilient, yet which retains good hand and drape properties after bonding. More particularly, it is desired to provide a stretchable cloth-like nonwoven laminate without the use of conventional laminate bonding methods, e.g., without mechanical needling, fusion, chemical bonding, etc.

It is further desired to provide a nonwoven material, either a single web or laminate, of elastic and/or nonelastic material, having the properties discussed above, by a simple method, using simple apparatus.

While the above-discussed documents may disclose products, processes and apparatus which exhibit some of the characteristics of the present invention, none of them discloses or suggests the present invention, including the advantages thereof, which achieve the objectives as discussed below.

SUMMARY OF THE INVENTION

Accordingly, it is an object of the present invention to provide a bonded nonwoven material retaining a high overall bulk and increased texture, and good hand and drape, and a method and apparatus for providing such bonded nonwoven material.

It is a further object of the present invention to provide a bonded nonwoven material, either a single web or a laminate, the bonded nonwoven material being either elastic or nonelastic, retaining a high overall bulk in the bonded material, the bonded material having good hand and drape, the bonded material being provided without using conventional bonding means such as fusion or chemical bonding, or mechanical needling.

It is a further object of the present invention to provide a nonwoven elastomeric laminate (e.g., a nonwoven fibrous elastomeric laminate) that is stretchable and resilient, and has good hand and drape properties even after the bonding used to form the laminate, methods of forming such laminate, and an apparatus for forming such laminate.

It is a further object of the present invention to provide a nonwoven elastomeric laminate that is cloth-like, and that can be formed without the necessity of utilizing conventional bonding methods such as mechanical needling, fusion or chemical bonding, whereby good hand and drape properties can be retained after bonding.

The present invention achieves each of these objects utilizing hydraulic entanglement to spot-entangle-bond (jet treat) unbonded nonwoven material (either a single web or a laminate), the material (e.g., fibers of the web or laminate) being entangled and intertwined only in spots (that is, not over the entire surface of the material). By utilizing hydraulic entanglement of the web (or laminate) in spots, the overall bulk of the web (or laminate) is substantially retained, as compared, e.g., to bonding by hydraulic entanglement of the web over the entire surface thereof. Moreover, a bonded product is provided with a limited number of pin-holes, or with no pin-holes. Moreover, by providing the bonds by spot-entangle-bonding (spot-jet-treated) the material is strong. Moreover, with thermally bonded materials breaks can occur next to the bond, where the fibers have been melted. Furthermore, since the spot-entangle-bond is substantially independent of the composition of the nonwoven material (as long as the material can be spot-entangle bonded), nonwoven materials of dissimilar composition can be bonded; moreover, bonding can be provided without producing film-like materials (in particular, film-like materials are formed at bond points when thermal spot-bonding is used).

Generally, spot-entangle-bonding (either of a single web or of a laminate) provides a material having greater overall bulk as compared to a material fusion-bonded or bonded with adhesives over the entire surface, or subjected generally to hydraulic entanglement. Such spot-entanble-bonded materials, including laminates, have a wide range of uses, from disposables, e.g., absorbents, wipes and outer covers, etc., to durable goods.

While a substantial part of the remainder of the present disclosure is directed to forming nonwoven elastomeric laminates, the present invention is not limited thereto, and can be used to bond single nonwoven webs of either elastomeric or nonelastic material (e.g., single nonwoven fibrous webs, such as single nonwoven meltblown webs), or a nonelastic laminate. The present invention includes within its scope nonwoven webs, or laminates, of pulp fibers that have been spot-entangle-bonded. Thus, within the scope of the present invention are nonwoven webs, of 100% cellulose fibers, that have been spot-jet-treated, including (1) a single layer of 100% wood pulp fibers, (2) a laminate of wood pulp fiber layers (including layers of different wood pulp fibers), etc. Also within the scope of the present invention are nonwoven webs, of staple fibers, that have been spot-entangle-bonded. Moreover, a spot-entangle-bonded web of a coform (admixture) of meltblown fibers and further fibrous material (e.g., pulp fibers and/or staple fibers and/or meltblown fibers and/or continuous filaments), with or without particulate material, falls within the scope of the present invention. Where laminates are spot-entangle-bonded , the nonwoven webs need not even be fibrous; for example, two layers of foam polymer material can be spot-entangle-bonded within the scope of the present invention where at least one of the two layers include a fibrous material or at least one fibrous layer is provided between the two foam layers, the entangling jet streams having sufficient force to entangle sufficient portions of the two layers of the foam and the fibrous material. Thus, the present invention is useful generally for providing a bonded material having retained overall bulk and retained hand and feel.

As for the nonwoven elastomeric laminate embodiment of the present invention, the above-described objects are achieved by providing a composite of a nonwoven elastomeric web together with at least one further nonwoven web, and utilizing hydraulic entanglement to spot-entangle-bond such two or more webs together to form a laminate, with the fibers of the webs being entangled only in spots (that is, not over the entire interface between the webs). In other words, high pressure water jets are directed at the surface of one of the webs, while the webs are positioned adjacent to each other, so as to spot-bond the webs together by mechanically entangling and intertwining fibrous material of the webs only at such spots. By such spot-entangle-bonding of the webs, the resulting laminate remains stretchable and resilient; moreover, since conventional bonding methods, such as mechanical needling, fusion or chemical bonding, are not used, good hand and drape properties can be readily retained after the bonding. Furthermore, since thermal bonding is not used, the elasticity of the nonwoven elastomeric web is not destroyed, so that the bonding area can be increased (as compared, e.g., to spot-bonding using thermal bonding) without a deleterious effect on the elasticity of the elastomeric web.

Desirably, the nonwoven elastomeric web of the laminate is a meltblown elastomeric web that has been subjected to a pre-entangling step, prior to the spot-entangle-bonding. Such pre-entangling (that is, a pre-entangling of the meltblown elastomeric web over the entire surface thereof) provides bundles of the meltblown fibers and aligns the fibers in the web. Such pre-entangling also opens the web to allow better penetration during the spot-entangle-bonding. The pre-entangling is performed to improve the spot-entangle-bonding, and to improve the elasticity of the laminate.

The laminates produced have a wide range of uses, from disposables such as wipes, outer covers (e.g., for diapers), etc., to durable goods.

In addition, by utilizing hydraulic entanglement so as to entangle fibers, in spots, of the at least two webs, the laminate can easily and efficiently be provided.

With respect to the individual webs utilized to provide the laminate, the two adjacent webs desirably are to contain a sufficient amount of fibrous material (e.g., fibers) that can be readily entangle bonded with material (such as fibrous material) of the adjacent web. These fibers that entangle-bond with fibrous material of the adjacent web must have sufficient fiber mobility, small enough diameters and a sufficient number of loose ends in order to wrap around fiber cross-over points. Webs made from natural or synthetic pulp fibers, staple fibers, meltblown fibers, or coforms (that is, an admixture of (1) meltblown fibers and (2) pulp fibers and/or staple fibers and/or meltblown fibers and/or continuous filaments, with or without particulate material) have been shown to be effective for entangling less mobile fibers.

Furthermore, the present invention provides apparatus for spot-entangle-bonding or jet treating, whereby the spot-entangle-bonded webs, including the elastic laminates, of the present invention can easily be obtained. In particular, the present invention utilizes a perforated member, with the web (or composite webs) to be spot-bonded being positioned adjacent or at least close to the perforated member, and with water jets passed through the openings in the perforated member so as to hydraulically entangle fibers and form the spot-entangle-bonds. The web (or composite of webs) can be positioned first with one side and then with the opposed side adjacent the perforated member, so as to provide spot-bonding of both sides thereof; such spot-bonding of both sides is particularly appropriate when a sandwich of webs, having an intermediate elastomeric web and sandwiching webs of fibrous material, is used, with the sandwiching webs containing a sufficient number of fibers that can readily entangle bond with other fibers.

Preferably, the perforated member is a rotatable apertured drum, with the water jets positioned inside the drum and directed through the openings in the drum against the web (or composite) on the circumference of the drum. The water jets preferably direct the water perpendicularly to the web being treated. By this, water jets can be applied on and off so as to provide the spot bonding. A support is provided adjacent the outer surface of the drum to support the web (or composite) adjacent or at least close to the drum; such support is normally apertured. Use of an apertured drum wherein the circumferential wall (that is, the wall having the apertures) has a relatively small thickness (e.g., 1/16″ rather than ⅜″) is preferred, so as to provide more effective entangle-bonding. By using the rotatable apertured drum as presently described, with the drum rotating so the linear speed of the circumference is substantially the same as that of the web (laminate), a continuous web (laminate) can be spot-entangle-bonded at one side.

Desirably, the apparatus for producing the hydraulically spot-entangle-bonded laminates includes two perforated drums, with the web (composite) contacting (or nearly contacting) the circumference of the drums and water jets being contained inside each of the drums so as to direct water jets on the web through the perforated drum and provide the spot-entangle-bonds. Desirably, the two perforated drums are so situated so that initially one side of the web (composite) is adjacent the first drum, and then the second side of the web (composite) is adjacent the second drum. By use of this specific apparatus, including the two drums, synchronization and control of the bonding pattern, with both sides of the fabric being bonded, can easily be achieved. Moreover, noting that the spot-entangle-bonds are dependent upon the aperture pattern in the drums, the use of drums allows the bonding patterns to be easily changed; furthermore, the use of the drums allows faster line speeds.

Furthermore, the use of the drums readily allows the elastic webs to be controllably stretched, at the time of the spot-entangle-bonding, whereby a stretchable nonwoven elastomeric laminate, having desired stretch and recovery characteristics, can easily be achieved. In addition, use of the drums reduces various common production problems faced in forming stretch-bonded-laminates, including material uniformity, drawing of the material, etc. Use of such controlled stretch, when providing the spot-bonding, and the product formed thereby, is also part of the present invention.

The apparatus is very versatile, since the bonding and product characteristics, including any bonding pattern, can be easily modified by changing drums. Moreover, the apparatus efficiently uses energy (that is, energy to provide the jets of water for the spot-entangling).

Thus, the present invention permits formation of bonded nonwoven material, including nonwoven elastic laminates of various materials, without consideration of whether conventional bonding techniques (e.g., fusion or chemical adhesives) can be utilized with such materials. Moreover, and as indicated previously, the present invention provides a laminate having cloth-like properties, with good hand and drape properties after bonding.

DETAILED DESCRIPTION OF THE INVENTION

Figure 2:
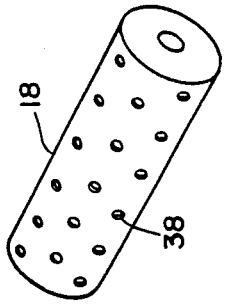
FIG. 2 shows a perforated drum used in the apparatus of the present invention.

While the invention will be described in connection with specific and preferred embodiments, it will be understood that it is not intended to limit the invention to those embodiments. On the contrary, it is intended to cover all alterations, modifications and equivalents as may be included within the spirit and scope of the invention as defined by the appended claims.

The present invention contemplates a nonwoven material formed by spot-entangle-bonding at least one nonwoven web (e.g., a nonwoven fibrous web, including a single web of 100% wood pulp fibers), the spot-entangle-bonds being formed by hydraulic entanglement. Laminates of at least one nonwoven web (e.g., a web of foam polymer material, a nonwoven fibrous web) with other fabric materials, such as woven and knit materials, with the laminates being bonded together by spot-entangle-bonds, are also within the contemplation of the present invention.

As a specific embodiment, the present invention contemplates a nonwoven elastic laminate formed by spot-bonding a nonwoven elastic web to another nonwoven web, the spot-bonds being formed by hydraulic entanglement. To make the bonded laminates, high pressure water jets are used to entangle-bond spots of the laminated webs together. That is, specific areas of the interface betweeen two webs of a composite have fibrous material from each of the webs hydraulically entangled together due to the high-pressure jets, while other areas do not have fibers from each of the webs hydraulically entangled due to the jets. By hydraulically entangled, we mean that fibrous portions (e.g., fibers) of the two webs mechanically entangle and intertwine together due to high-pressure liquid columnar streams jetted toward a surface of the composite.

Prior to further description of the present invention, various terms utilized herein will be defined. Thus, the terms "elastic" and "elastomeric" are used interchangeably herein to mean any material which, upon application of a force, is stretchable to a stretched length which is at least about 110% of its relaxed length, and which will recover at least about 40% of its elongation upon release of the stretching, elongating force. For many uses (e.g., garment purposes), a large amount of elongation (e.g., over 12%) is not necessary, and the important criterion is the recovery property. Many elastic materials may be stretched by much more than 25% of their relaxed length and many of these will recover to substantially their original relaxed length upon release of the stretching, elongating force.

As used herein the term "recover" refers to a contraction of a stretched material upon termination of a biasing force following stretching of the material by application of the biasing force. For example, if the material having a relaxed, unbiased length of one (1) inch was elongated 50% by stretching to a length of 1 and ½ (1.5 inches the material would have a stretched length that is 150% of its relaxed length. If this exemplary stretched material contracted, that is recovered, to a length of 1 and 1/10 (1.1) inches, after release of the biasing and stretching force, the material would have recovered 80% (0.4 inch) of its elongation.

As used herein, the term "meltblown fibers" means fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameter. Thereafter, the meltblown fibers are carried by the high velocity gas stream and are deposited on a collecting surface to form a web of randomly dispersed meltblown fibers (e.g., microfibers). Such a process is disclosed, for example, in U.S. Pat. No. 3,849,241 to Buntin et al, and the disclosure of this patent is hereby incorporated by reference.

As used herein, "polymer" includes both homopolymers and copolymers. Moreover, "nonwoven webs" include any nonwoven, including nonwoven webs formed solely of staple fibers, solely of pulp fibers, etc.

Generally, materials for adjacent webs to be spot-entangle-bonded can be materials as described in the previously discussed U.S. Pat. No. 4,657,802 to Morman, the contents of which are incorporated herein by reference. Illustratively, the nonwoven web can be a meltblown web of, e.g., elastomeric or nonelastomeric materials. Exemplary of nonelastomeric materials are various polyester or polyolefin materials, including polyethylene terephthalate and polypropylene. Such web can be a coform of the meltblown fibers together with pulp and/or staple fibers, the staple fibers being synthetic and/or natural staple fibers. As for such coform materials, containing an admixture of (1) meltblown and (2) staple and/or pulp fibers, see U.S. Pat. No. 4,100,324 to Anderson et al, the contents of which are incorporated herein by reference.

In addition, such webs can also have particulate material incorporated therein, including, e.g., super absorbent materials. A preferable technique with respect to the inclusion of super-absorbent material is to include a material in the coform which can be chemically modified to absorb water after the hydraulic entanglement treatment, such as disclosed in U.S. Pat. No. 3,563,241 to Evans, et al. Other techniques for modifying the water solubility and/or absorbency are described in U.S. Pat. Nos. 3,379,720 and 4,128,692 to Reid.

Alternatively, such nonwoven webs can be webs made from staple fibers, such as, e.g., carded webs, known in the art. Other types of webs, including, e.g., webs becoming fibrous during the hydraulic entangling, can be used for the nonwoven web, as long as they, together with the nonwoven elastomeric web, can be hydraulically entangled to form the spot-bonded laminate.

For example, in providing a laminate with sandwiching webs A and C, and with B as an intermediate, elastic meltblown web, the meltblown fibers have substantial length and are less mobile. Accordingly, the webs A and C should contain a sufficient number of fibers having sufficient fiber mobility, small enough diameters and loose ends so as to wrap around fiber cross-over points.

As for the nonwoven elastomeric web, a preferred form is a meltblown web, for example, a meltblown web having meltblown fibers of 20–100 micron diameter, even more particularly around 20 microns in diameter. However, such is illustrative and not limiting.

The spot-entangle-bonded laminate (or web) of the present invention can be further laminated to a film, or can be provided with a coating (for example, an extruded coating) to achieve a product having desired properties (e.g., strength, hand, etc.).

In addition, a laminate can be provided, within the scope of the present invention, having a surface in a desired pattern. Thus, a layer of relatively loose fibers can be provided on, e.g., a fibrous layer, with the composite being subjected to patterned spot-entangling so as to bond desired areas of the relatively loose fibers and fibrous layer in the desired pattern. For example, the water jets can be passed through an apertured member, the apertured member having apertures so as to provide a desired pattern (for example, the apertures can have a desired configuration and/or each aperture can have a desired shape). Thereafter, the remaining relatively loose fibers can be washed off, leaving the bonded fibers in the form of the desired pattern. Various uses for such patterned laminate, such as for wall covering, can be appreciated.

Exemplary elastomeric materials for use in formation of the elastic web include polyester elastomeric materials such as, for example, polyester elastomeric materials available under the trade designation "Hytrel" from E.I. DuPont De Nemours & Co., polyurethane elastomeric material such as, for example, polyurethane elastomeric materials available under the trade designation "Estane" from B. F. Goodrich & Co., polyimide elastomeric material such as, for example, polyimide elastomeric materials available under the trade designation "Pebax" from the Rilsan Company, and polyetherester elastomeric materials such as, for example, polyetherester elastomeric materials available under the trade designation "Arnitel" from Schulman, Inc. or Akzo Plastics.

Other elastomeric materials for use in forming the elastic web include (a) elastomeric A-B-A' block copolymers, where A and A' are each a thermoplastic polymer end block which includes a styrenic moiety and where A may be the same thermoplastic polymer end block as A', for example, a poly(vinyl arene), and where B is an elastomeric polymer mid block such as conjugated diene or a lower alkene; and (b) blends of one or more polyolefins or poly(alpha-methylstyrene) with elastomeric A-B-A' block copolymer materials, where A and A' are each polymer thermoplastic end blocks containing a styrenic moiety and where A may be the same thermoplastic polymer end block as A', such as a poly(vinyl arene) and where B is an elastomeric polymer mid block, such as a conjugated diene or a lower alkene. Further description of these materials for the nonwoven elastic web, including further description of such elastomeric block copolymers, are set forth in U.S. Pat. No. 4,657,802, incorporated herein by reference.

Various elastomeric A-B-A' block copolymer materials are disclosed in U.S. Pat. Nos. 4,323,534 to Des Marais and U.S. Pat. No. 4,355,425 to Jones, the contents of each of which are incorporated herein by reference, and are available as "Kraton" polymers from the Shell Chemical Company. When utilizing various of the "Kraton" materials (e.g., "Kraton" G), it is preferred to blend a polyolefin therewith, in order to improve meltblowing of such block copolymers; a particularly preferred polyolefin for blending with the "Kraton" G block copolymers is polyethylene, a preferred polyethylene being Petrothene Na601 obtained from U.S.I. Chemicals Company. Discussion of various "Kraton" blends for meltblowing purposes are described in U.S. Pat. No. 4,657,802, previously incorporated by reference, and reference is directed thereto for purposes of such "Kraton" blends.

Figure 1:
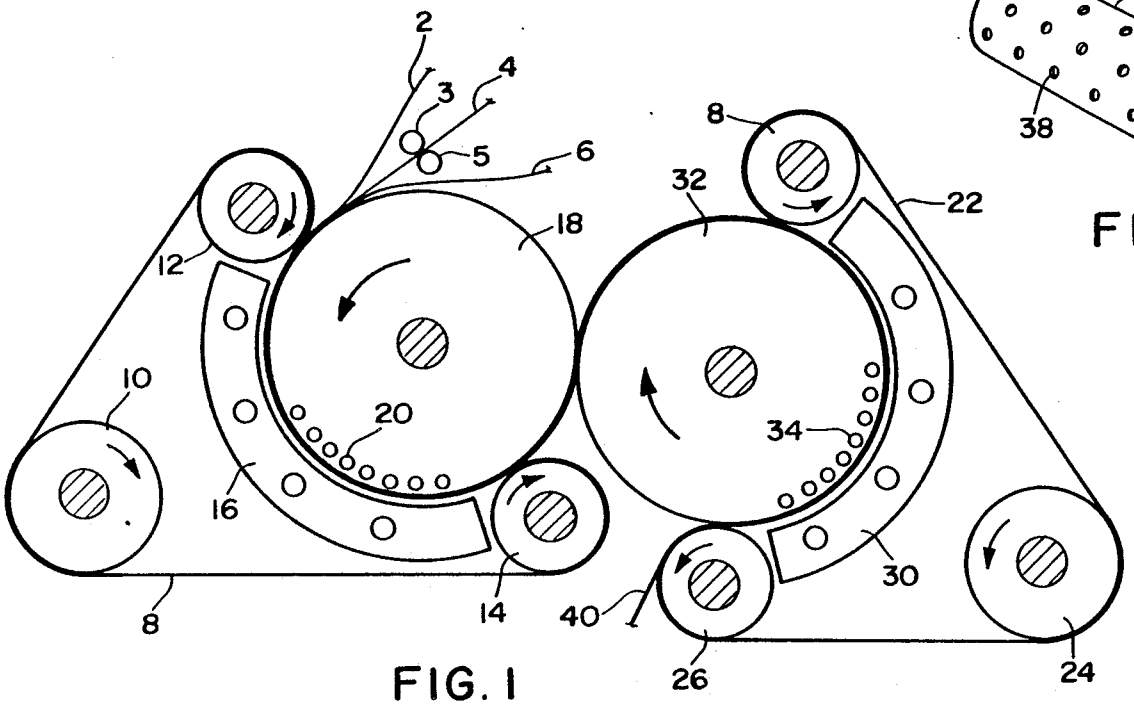
FIG. 1 is a schematic view of an apparatus for forming a nonwoven hydraulically entangled elastic laminate of the present invention.

FIG. 1 shows apparatus for producing spot-bonded laminates of the present invention. In particular, FIG. 1 shows preferred apparatus for producing the nonwoven elastomeric laminates within the scope of the present invention. Such apparatus is not limiting, and is merely illustrative of specific apparatus for forming such laminates. Thus, webs 2, 4 and 6, with web 4 being an intermediate, elastic web, are provided adjacent each other so as to form a composite to be spot-bonded to form the nonwoven laminate. The substrate 4 is subjected to control draw nip rolls, e.g., prior to coming in contact with webs 2 and 6, so as to stretch such web 4. By use of the controlled drawing, provided by rolls 3 and 5, a final product is provided that has controlled stretch and which does not easily delaminate.

After being positioned adjacent each other, the composite of webs 2, 4 and 6 is passed into contact with rotatable perforated drum 18. A continuous backing member 8 (e.g., a mesh (open) belt) passes around rolls 10, 12 and 14 and causes the composite of webs 2, 4 and 6 to be positioned adjacent the perforated drum.

Where the web to be spot-entangle-bonded is a web of pulp fibers (e.g., 100% cellulosic fibers), the web is not held in contact with the drum, but rather is spaced slightly therefrom. In this embodiment, it is desired to have a further support member, e.g., on the sides of backing member 8, to provide the backing member 8 (and, consequently, the web that is being spot-entangle-bonded) in a shape (curved) corresponding to the shape of the drum.

The perforated drum has water jet manifolds 20 therein, wherein water from such water jet manifolds is caused to pass through the openings in the perforated drum and provide the high pressure water jets to cause entanglement. On the side of the webs 2, 4, 6, opposite the side adjacent the perforated drum is vacuum means 16. Such vacuum means assists in removing water from the composite of webs 2, 4 and 6 and improves the hydraulic bonding.

By providing the rotatable apertured drum to rotate such that the circumference of the drum is at substantially the same linear speed as the speed of the webs 2, 4 and 6, substantially the same portion of the webs remain adjacent the openings in the drum. Spot bonding or jet treating is performed at these locations of the webs adjacent the openings in the perforated drum, through which the water jets are transmitted.

After passing by perforated drum 18, the laminate, spot-bonded by hydraulic entangling from one side, can have the other side thereof passed in contact with a second rotatable perforated drum (second rotatable perforated drum 32). This second perforated drum also has associated therewith a continuous backing 22, which passes around rollers 24, 26 and 28 so as to cause the continuous backing to support the laminate of webs 2, 4 and 6 in contact with the second rotatable perforated drum 32. As the laminate passes along the periphery of the second rotatable perforated drum 32, it is subjected to high pressure water jets from water jet manifolds 34, so as to provide hydraulically entangled spot-bonds preferably from the side of the laminate opposite the side spot-entangle-bonded adjacent the first drum 18. As with the first perforated drum, a vacuum manifold 30 is provided on the side of the laminate opposite the side adjacent the second drum, in the zone where the high pressure water jets contact the laminate, so as to remove water from the laminate and increase the hydraulic entanglement. The spot-bonds on the opposed sides of the laminate need not line up with each other. Of course, the spot-bonds can be provided to be close to lining up, but since they are formed on different drums, they will not always completely line up.

While not shown, after the last spot-entangle-bonding treatment the laminate can be passed through a dryer, and/or subjected to further treatments, including a softening treatment, printing on the laminate, additional bonding (e.g., conventional bonding and/or general hydraulic entanglement), etc. Techniques to perform such softening and printing treatments, and additional bonding, are known.

The formed laminate 40 can then be rolled up, e.g., for storage and shipment, and can be used in a wide variety of goods, from disposables to durable goods.

It can be appreciated that while FIG. 1 shows treatment of a laminate of webs 2, 4 and 6, a single web (of elastomeric or nonelastic material) can be spot-entangle-bonded by passing, e.g., a single fibrous nonwoven web adjacent (in contact with, or at least close to) drum 18 and/or drum 32.

FIG. 2 is a perspective view of the rotatable perforated drum of the present invention. As can be seen, while drum 18 is shown, a similar drum is utilized for the second perforated drum 32. This perforated drum has openings 38 all over the circumference thereof; accordingly, since during formation of the spot-bonding the perforated drums are rotated, sequentially the openings in the circumference are in line with the water jet manifolds, so as to provide the high pressure water jets necessary for the hydraulic entanglement. Of course, the water jets can be shut off when facing areas of the web not to be subjected to spot-entangle-bonding or jet treatment. Thus, intermittent use of the water jets, to achieve spot-entangle-bonding, is within the scope of the present invention.

Hydraulic entanglement, as a technique for providing mechanical bonding (e.g., fiber entangling), is known. In this regard, attention is directed to U.S. Pat. No. 3,485,706 to Evans, the contents of which are incorporated herein by reference. For purposes of the present invention, the specific parameters for the hydraulic entangling (e.g., water pressure of the water jets, size of the water jets, etc.) must be sufficient to move the fibrous material of the fibrous webs so as to spot-entangle-bond or jet treat fibrous material of adjacent webs (or a single web) to provide a laminate (or single web) that will not come apart.

Generally, in providing a laminate, the area of the spot-entangle-bonds corresponds to that used in stretch-bonded-laminates using conventional bonding techniques, and in connection therewith attention is again directed to U.S. Pat. No. 4,657,802. Illustratively, the laminate generally has 20–35% bonded area. However, this bonded area range is not limiting, and the bonded area can be greater (e.g., 50%). Of course, an increase in bonding area will effect the elasticity of the spot-entangle-bonded product.

As indicated previously, utilizing the perforated drum ~~of~~ FIG. ~~2,~~ the water jets are provided such that entanglement through the laminate (or single web) occurs only at the openings of the drum. Of course, thereafter a hydraulic entanglement over the entire surface of the laminate (or web) can be used. However, by providing spot bonds, rather than bonding generally over the entire laminate, when providing an elastomeric laminate having a nonwoven elastic web and a nonelastic web, the nonwoven elastic web is not totally locked up, and the laminate remains stretchable. In this regard, if a nonwoven elastic web is sandwiched between nonwoven fibrous webs and the composite is passed under high-pressure water jets, a laminate will be produced that does not easily delaminate; however, the laminate also will not readily stretch, because of all of the fibers of the three layers interlocking, such interlocking preventing adequate slippage and movement of the elastic fibers. By use of spot-entangle-bonding, the resultant laminate is stretchable.

Moreover, by utilizing two drums, arranged as shown, both sides of the fabric can be treated, and this will increase the strength of the bonded points. In addition, by controlling the elastic web tension by, e.g., pre-stretching (for example, using nip rolls, as shown in FIG. 1, or utilizing Mount Hope rolls, or a tenter frame, as known in the art to provide cross direction stretch), added controlled stretch, resiliency and bulk can be given to the product.

If additional strength is desired, the bonding area can be increased, and/or after the entangle bonding additional bonding using conventional techniques (e.g., fusion bonding, chemical bonding, etc.) can be used. Even where such conventional techniques are utilized for additional bonding, the strength increase versus loss in hand and drape properties, and the loss in visual aesthetics, would not be as great as when simply bonding via such conventional methods.

In forming the laminate including, e.g., (1) a nonwoven nonelastic coform material web of meltblown polypropylene fibers and polyethylene terephthalate staple fibers, and (2) an elastic web of meltblown fibers, the nonwoven coform can be initially subjected to hydraulic entanglement on one side only by itself. By such entanglement on one side only, "fuzzy" fibers protruded from the opposite side (untreated side); these protruding fibers were used later to entangle elastic fibers. The coform can then be placed on a meltblown elastic web, with the fuzzy side of the coform in contact with the elastic web. Then the laminate can be subjected to spot-entangle-bonding. With bonding only at spots, the entangled product could easily be stretched and had a definitive "stopping point".

An example of processing conditions and materials will be set forth as illustrative of the present invention. Of course, such example is not limiting. Thus, the following layers were used as the webs to be laminated for providing the hydraulically entangled spot-bonded laminate:

(1) a pulp coform of approx. 30% by weight International Paper Super Soft wood pulp fiber material - approx. 70% meltblown polypropylene, having a basis weight of approx. 30 g/m$^2$;

(2) a meltblown elastic web of meltblown fibers formed from a blend of approx. 30% by weight polyethylene and approx. 70% by weight of "Kraton" G, a polystyrene-poly(ethylenebutylene)-polystyrene elastomeric block copolymer from Shell Chemical Co., having a basis weight of approx. 85 g/m$^2$; and (3) a pulp coform of approx. 30% by weight IPSS-approx. 70% meltblown polypropylene fibers, having a basis weight of approx. 30 g/m$^2$.

A composite of the above-listed three layers was subjected to a hydraulic entanglement treatment at an entangling line speed of 23 feet/min. using a Honeycomb manifold (from Honeycomb Systems, Inc., Biddeford, Maine) and jets with 0.005 inch orifices 40 orifices per inch and one row of orifices. The pulp coforms were initially treated on one side with three passes at a water pressure of 500 psi (all treatment pressures were read as gauge pressure) during each pass using a 100×92 mesh semi-twill stainless steel support wire.

Afterwards the two coforms were placed on each side of the elastomeric web, with the untreated sides (fuzzy sides) of the coforms facing the elastomeric web. The elastomeric web had been pre-stretched on a support frame 150% in the machine direction of the web. The composite of three webs were then placed on top of the 100×92 support wire and a 1/16" thick perforated plate having 3/16" diameter staggered holes on 5/8" centers was placed on top of the webs. The composite was then subjected to hydraulic entangling through the perforated plate with three passes at a water pressure of 1600 psi (gauge) during each pass. The laminate was then removed from the support frame to relax the web, then physically tested.

Figure 3A:
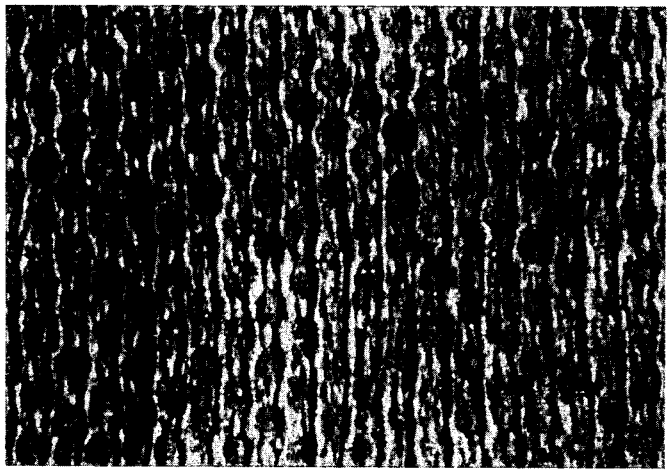
FIGS. 3A and 3B are photomicrographs of respective opposed sides of a spot-bonded laminate of the present invention.
Figure 3B:
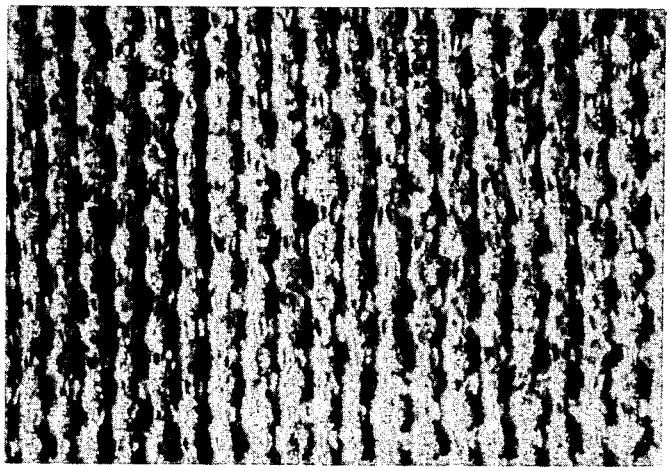

The material formed by the above-described procedure is shown in FIGS. 3A and 3B, where FIG. 3A shows the surface of the spot-bonded material that had been closest to the perforated plate during the spot-entangle-bonding, and FIG. 3B showing the opposed surface. In these figures, the protruding areas are unbonded areas, while the remaining areas are the areas of the spot-bonds.

Physical properties of the formed material are shown in the following Table 1; as a comparison is shown physical properties of two conventional hydraulically entangled nonwoven fibrous materials, "Sontara"8005, a spunlaced 100% polyethylene terephthalate staple fiber fabric (the fibers having a fiber size of 1.35 d.p.f. ×3/4") from E. I. DuPont De Nemours & Co., having a basis weight of 65 g/m$^2$, and "Optima", a converted product from American Hospital Supply Corp. having a composition of about 55% Western red cedar pulp fibers and 45% polyethylene terephthalate staple fibers, and having a basis weight of 72 g/m$^2$.

Physical properties of the materials as set forth in Table 1 were measured in the following manner:

The bulk was measured using a bulk or thickness tester available in the art. The bulk was measured to the nearest 0.001 inch.

The MD and CD grab tensiles were measured in accordance with Federal Test Method Standard No. 191A (Methods 5041 and 5100, respectively).

The elongation and recovery tests were conducted as follows. Three inch wide by four inch long samples were stretched in four inch Instrom jaws to the elongation length, described as % Elongation. For example, a four inch length stretched to a 5⅝" length would be elongated 40.6%. The initial load (lbs.) was recorded, then after 3 minutes was recorded before relaxing the sample. Thereafter, the length was measured, and initial percent recovery determined. This is recorded as initial percent recovery. For example, if a material was stretched to 4½" (12.5% Elongation) and then after relaxation measured 4-1/16", the sample recovery was 87.5%. After thirty (30) minutes, the length was again measured and a determination made (and recorded) as percent recovery after thirty (30) minutes. This elongation test is not a measure of the elastic limit, the elongation being chosen within the elastic limit.

Such nonwoven elastomeric laminate has a high overall bulk and good texture, the bulk being retained to a higher degree particularly with respect to hydraulically entangled webs which have been subjected to entangling over their entire surfaces. Moreover, the laminates of the present invention have good strength, the bond areas thereof being no weaker than other areas of the web. Also, the jet treatment provides a product having good hand and drape. Furthermore, the spot-bonded laminate of Table 1 does not have pin-holes.

This case is one of a group of cases which are being filed on the same date. The group includes (1) "Nonwoven Fibrous Hydraulically Entangled Elastic Coform Material and Method of Formation Thereof", F. Radwanski (Application Ser. No. 07/170,196); (2) "Nonwoven Fibrous Hydraulically Entangled Non-Elastic Coform Material and Method of Formation Thereof", F. Radwanski, et al. (Application Ser. No. 07/170,108); (3) "Hydraulically Entangled Nonwoven Elastomeric Web and Method of Forming the Same", F. Radwanski, et al. (Application Ser. No. 170,209); (4) "Nonwoven Hydraulically Entangled Non-Elastic Web and Method of Formation Thereof", L. Chambers, et al. (Application Ser. No. 07/170,200); and (5) "Nonwoven Material Subjected to Hydraulic Jet Treatment in Spots, and Method and Apparatus for Producing the Same", F. Radwanski (Application Ser. No. 07/170,193). The contents of the other applications in this group, other than the present application, are incorporated herein by reference.

While I have shown and described several embodiments in accordance with the present invention, it is understood that the same is not limited thereto, but is susceptible of numerous changes and modifications as are known to one having ordinary skill in the art, and I therefor do not wish to be limited to the details shown and described herein, but intend to cover all such modifications as are encompassed by the scope of the appended claims.

TABLE 1

| | | | MD Grab Tensiles | | | | |
|---|---|---|---|---|---|---|---|
| Example | Basis Wt. (gsm) | Bulk (in) | Peak Energy (in-lb) | Peak Load (lb) | Peak Elongation (in) | Peak Strain (%) | Fail Energy (in-lb) |
| Laminate of the present Invention | 183 | .072 | 7.7 | 7.2 | 2.7 | 90.1 | 22.1 |
| Sontara ® 8005 | 65 | .020 | 20.1 | 42.3 | 1.0 | 34.6 | 40.4 |
| Optima ® | 72 | .020 | 12.9 | 26.3 | 1.0 | 33.8 | 35.1 |

| | CD Grab Tensiles | | | | |
|---|---|---|---|---|---|
| Example | Peak Energy (in-lb) | Peak Load (lb) | Peak Elongation (in) | Peak Strain (%) | Fail Energy (in-lb) |
| Laminate of the present Invention | 6.0 | 6.1 | 1.9 | 61.8 | 15.5 |
| Sontara ® 8005 | 23.0 | 18.5 | 4.0 | 134.3 | 39.8 |
| Optima ® | 16.6 | 22.1 | 2.1 | 71.0 | 32.0 |

| | MD Elongation & Recovery | | | | | CD Elongation & Recovery | | | | |
|---|---|---|---|---|---|---|---|---|---|---|
| Example | Elongation % | Initial Load lbs | 3 min. Load lbs | Initial Percent Recovery | Percent Recovery After 30 min. | Elongation % | Initial Load lbs | 3 min. Load lbs | Initial Percent Recovery | Percent Recovery After 30 min. |
| Laminate of the present Invention | 34 | 2.7 | 1.8 | 91 | 99 | 19 | 3.0 | 1.7 | 91 | 95 |

As shown in the foregoing Table 1, the nonwoven elastomeric laminate of the present invention has good elongation and recovery, and also has good strength.

What is claimed is:

1. A spot-entangled material comprising:

at least one nonwoven web having two surfaces, and spot-entangle-bonds in which the material of the nonwoven web is entangled and intertwined in the thickness direction between the two surfaces;

wherein the spot-entangle-bonds have been provided by hydraulic entanglement of the nonwoven web at spots of at least one of the two surfaces.

2. The spot-entangled material according to claim 1, wherein the nonwoven web is a nonwoven fibrous web.

3. The spot-entangled material according to claim 2, wherein said nonwoven fibrous web is an admixture of (1) meltblown fibers and (2) at least one of pulp fibers, staple fibers, additional meltblown fibers, and continuous filaments.

4. The spot-entangled material according to claim 3, wherein said admixture further includes particulate material.

5. The spot-entangled nonwoven material according to claim 1, wherein said nonwoven web is a web comprising pulp fibers and staple fibers.

6. The spot-entangled nonwoven material according to claim 1, further including at least one additional web selected from the group consisting of a knit web and a woven web.

7. An elastomeric laminate comprising:

at least one elastomeric web, at least one fibrous web, and spot-entangle-bonds in which material of the elastomeric web and the fibrous web are entangled and intertwined in spots, wherein the spot-entangle-bonds have been provided by hydraulic entanglement.

8. The laminate according to claim 7, wherein said elastomeric web is a nonwoven elastomeric web of meltblown fibers.

9. The laminate according to claim 7, wherein the fibrous web is a nonwoven web of meltblown fibers.

10. The laminate according to claim 7, wherein the fibrous web is a fibrous web of an admixture of pulp and meltblown fibers.

11. The laminate according to claim 7, wherein the fibrous web is a web of staple fibers.

12. The laminate according to claim 7, wherein the spot-entangle-bonding is a bonding provided by hydraulic entanglement while the elastomeric web is being stretched.

13. The laminate according to claim 7, wherein said elastomeric web is a fibrous nonwoven elastomeric web.

14. The laminate according to claim 13, wherein said fibrous nonwoven elastomeric web is sandwiched between two fibrous webs so that, each of the two fibrous webs are spot-entangle-bonded with the nonwoven elastomeric web.

15. The laminate according to claim 14, wherein the fibrous nonwoven elastomeric web is an elastomeric web of meltblown fibers.

16. The laminate according to claim 15, wherein the spot-entangle-bonding is provided by hydraulic entanglement while the elastomeric web is stretched.

17. A spot-entangled material comprising:

at least one layer of fibrous material, at least one other layer of materials, and spot-entangle-bonds in which fibers of the fibrous material are entangled and intertwined in spots with the other layer of material, wherein the spot-entangle-bonds have been provided by hydraulic entanglement.

18. The spot-entangled material according to claim 17, wherein the fibrous material is a nonwoven fibrous web.

19. The spot-entangled material according to claim 18, wherein the nonwoven fibrous web is an admixture of (1) meltblown fibers and (2) at least one of pulp fibers, staple fibers, additional meltblown fibers and continuous filaments.

20. The spot-entangled material according to claim 19, wherein the admixture further includes particulate material.

21. The spot-entangled nonwoven material according to claim 18, wherein the fibrous material comprises a mixture of pulp fibers and staple fibers.

22. The spot-entangled nonwoven material according to claim 17, wherein the other layer of material is selected from the group consisting of a knit web and a woven web.

23. The spot-entangled nonwoven material according to claim 17, wherein the other layer of material is a nonwoven fibrous web.

24. The spot-entangled material according to claim 23, wherein the nonwoven fibrous web is an admixture of (1) meltblown fibers and (2) at least one of pulp fibers, staple fibers, additional meltblown fibers, and continuous filaments.

25. The spot-entangled material according to claim 24, wherein the admixture further includes particulate material.

26. The spot-entangled nonwoven material according to claim 23, wherein the nonwoven fibrous web comprises a mixture of pulp fibers and staple fibers.

27. The spot-entangled material according to claim 17, wherein the layer of fibrous material is sandwiched between two layers of foam material.

* * * * *

UNITED STATES PATENT AND TRADEMARK OFFICE

CERTIFICATE OF CORRECTION

PATENT NO. : 4,970,104

DATED : November 13, 1990

INVENTOR(S) : Fred R. Radwanski

It is certified that error appears in the above-identified patent and that said Letters Patent is hereby corrected as shown below:

In the Abstract, line 23, "drum" should read --drums--

Column 1, lines 1 and 2, "NONWOVEN MATERIAL SUBJECTED TO HYDRAULIC JET TREATMENT IN SPOTS" should read --NONWOVEN MATERIAL SUBJECTED TO HYDRAULIC JET TREATMENT IN SPOTS, AND METHOD AND APPARATUS FOR PRODUCING THE SAME--

Column 14, line 42, "orifices 40" should read --orifices, 40--

Column 16, lines 14 and 15, "F. Radwanski" should read --F. Radwanski, et al.--

Column 16, line 18, "07/170,108" should read --07/170,208--

Signed and Sealed this

Eighth Day of June, 1993

Michael K. Kirk

*Attest:*

MICHAEL K. KIRK

*Attesting Officer*

*Acting Commissioner of Patents and Trademarks*